United States Patent [19]

Kim et al.

[11] Patent Number: 4,902,544

[45] Date of Patent: Feb. 20, 1990

[54] LEAK RESISTANT ABSORBENT PRODUCT

[75] Inventors: Dai W. Kim, Chatham, N.J.; Albert R. Cowling, Rosemont, Pa.

[73] Assignees: Sheen Kleen, Inc., King of Prussia, Pa.; Hoechst Celanese Corporation, Somerville, N.J.

[21] Appl. No.: 198,107

[22] Filed: May 24, 1988

[51] Int. Cl.[4] ..... B32B 3/06

[52] U.S. Cl. ..... 428/36.1; 15/209 R; 210/691; 428/240; 428/241; 428/253

[58] Field of Search ..... 428/36.1, 240, 241, 428/253; 210/691; 15/209 R

[56] References Cited

U.S. PATENT DOCUMENTS 4,737,394 4/1988 Zafiroglu ..... 428/240

*Primary Examiner*—Marion C. McCamish

*Attorney, Agent, or Firm*—Herbert P. Price

[57] ABSTRACT

Leak resistant absorbent articles are made from a tubular casing of liquid permeable fabric wherein the casing is loosely filled with a mixture of particles of a cross-linked hydrocolloid and particles of other liquid absorbing material.

26 Claims, No Drawings

LEAK RESISTANT ABSORBENT PRODUCT

BACKGROUND OF THE INVENTION

The field of art to which this invention is directed is articles for absorbing liquid spills.

Hydrophilic cloth, e.g., cotton or wool fabric, is commonly used in the home to absorb undesirable water, such as condensate on window sills and splashed water on bathroom floors. Cloth is an inefficient absorber having very little capacity. Wet cloth is soggy and exudes water under practically no pressure. Natural sponges as well as synthetic sponges made from foamed cellulose or foamed polyurethane are somewhat more efficient than cloth having a larger absorbing capacity. However, sponges also exude absorbed liquids when very little pressure is applied.

Aqueous and nonaqueous spills in the work place are normally controlled by spreading an absorbent material, e.g., sawdust, over the spill. The saturated material while on the floor causes hazardous footing and must be removed to prevent injury.

Various articles have been devised for absorbing undesirable liquids. U.S. Pat. No. 4,497,712 describes an absorbent pillow filled with ground corncobs which is non-selective and can be used to absorb oil and aqueous liquids such as acids or caustics.

Disposable diapers and personal sanitary products for use in absorbing body fluids are described in a number of patents, some of which are as follows: U.S. Pat. Nos. 3,669,103; 3,670,731; 3,783,872; 3,901,236; 4,008,353; and 4,381,732.

Diapers, floor mats, utility wiping cloths, and the like, which are made using a fluctuated clay mineral as the absorbent, are described in U.S. Pat. No. 3,935,363.

SUMMARY OF THE INVENTION

This invention is directed to absorbent articles for liquids. In one aspect, this invention pertains to articles for absorbing aqueous and nonaqueous liquids. In another aspect, this invention relates to a method for preventing the spread of liquid spills.

The absorbent article of this invention is made from a flexible tubular casing of liquid permeable fabric sealed at each end and containing therein discrete water insoluble particles of a crosslinked hydrocolloid. The absorbent article can be placed around a liquid spill and acts as a dam to prevent the spread of the spill while absorbing the liquid which contacts it.

The absorbent article of this invention can absorb up to 4000 percent by weight of aqueous solutions and will withstand up to 80 psi pressure with no leakage.

DESCRIPTION OF THE INVENTION

The tubular casing used in this invention is made of a flexible fabric which is permeable to liquid but will retain the fine particles of liquid absorbants with substantially no sifting through of solid material. The fabric can be made from any of the well known textile materials, such as cotton, wool, rayon, acetate, acrylic, polypropylene, poyester, or nylon. Preferred materials are polyester and nylon. Particularly preferred material is textured nylon. The fabric can be woven or knitted. Knitted fabrics, particularly those made using the circular needle process, are preferred. Such fabrics are produced in tubular form which can be readily used to make the compositions of this invention. Knitted fabrics made from textured nylon are particularly preferred because such fabrics have stretching, resiliency, and containment properties which are important for the manufacture of an expandable casing.

The tubular casing can also be made of nonwoven fabrics such as those made by the chemical and mechanical bonding of dry-laid webs, by wet processes using modified paper making techniques, or by spinbonding techniques. Of the nonwoven materials, spunbonded fabrics are preferred.

The cross-linked hydrocolloids useful in this invention are solid water insoluble but water swellable polymers which are capable of absorbing many times their own weight of water or aqueous solutions. These hydrocolloids are polymers of water soluble acrylic or vinyl monomers which are slightly crosslinked with a polyfunctional reactant. Such crosslinked polymers include polyvinylpyrrolidone, sulfonated polystyrene, polysulfoethyl acrylate, poly(2-hydroxyethylacrylate) polyacrylamide, polyacrylic acid, partial and complete alkali metal salts of polyacrylic acid, and the like. Also included are starch modified polyacrylic acids and hydrolyzed polyacrylonitrile and their alkali metal salts.

Useful hydrocolloids can be made by polymerizing acrylic acid and starch in an aqueous medium using a polyfunctional monomer, e.g., N,N-alkylene-bis-acrylamide, as the cross-linking agent. This process is described in U.S. 4,076,663. Hydrocolloids can also be made as described in U.S. 4,340,706 by the inverse polymerization of acrylic acid followed by cross-linking with a polyfunctional component, e.g., epichlorohydrin. Other hydrocolloids and processes for their manufacture are disclosed in U.S. Pat. Nos. 4,654,039; 3,669,103 and 3,670,731. All of the aforesaid patents are hereby incorporated by reference.

The hydrocolloids particularly useful in this invention are those described in U.S. Pat. Nos. 4,076,663 and 4,340,706. These hydrocolloids have a particle sizes of about 1 micrometer to about 2 millimeters and are capable of absorbing at least about 15 times their weight of aqueous fluid. These hydrocolloid particles swell when they absorb aqueous fluid. The particles maintain the approximate shapes and geometry they had before contact with the fluid but the dimensions thereof are greatly enlarged.

In preparing the articles of this invention, the crosslinked hydrocolloid is mixed with other particulate matter which is insoluble in water and organic liquids but which is capable of absorbing, or adsorbing, liquids. The crosslinked hydrocolloid is mixed with the other particulate matter in the amount of about 5 to about 50 weight percent, preferably about 10 to about 20 weight percent, of the hydrocolloid based on the weight of the mixture.

One example of other particulate matter is naturally occurring cellulose materials, such as saw dust, crushed corncobs, cotton linters, wood pulp, and the like. Preferred particulate matter of this type are crushed or ground corncobs which can absorb up to 5 times their weight of aqueous solutions or organic liquids.

Another type of particulate matter useful in this invention is silica gel which can adsorb fluids. Other useful adsorbants are molecular-sieve zeolites, activated alumina and calcium sulfate, also known by the trade name Drierite.

Ion-exchange resins can also be used as the other particulate matter in combination with the crosslinked hydrocolloids in this invention. Particularly useful ion-exchange resins are the strong acid, cation exchange resins.

Other particulate materials which can be mixed with hydrocolloids for use in this invention are clay minerals, such as kaolin, montmorillonite, illite, vermiculite, glauconite, attapulgite and the like. These clay minerals are mixtures of metal oxides, e.g., aluminum oxide, magnesium oxide, potassium oxide, and silicon oxide and generally exist in the amophous state. Fluctuated clay minerals, such as those described in U.S. Pat. No. 3,935,363, which is hereby incorporated by reference, are particularly useful in this invention.

Additional particulate materials are those made from cellular organic polymers, such as formed polyurethane, foamed rubber, both natural and synthetic, melt blown polypropylene, sponged, regenerated cellulose and the like.

The articles of this invention are made by loosely packing the textile casing with the absorbent mixture and sealing the ends of the casing. The articles, which are snake like in appearance, can have practically any dimension. However, they generally will have a diameter of no less than about 1 inch, preferably about two inches, up to about 1 foot, preferably about 6 inches. The lengths will vary from about 1 foot up to about 20 feet but, preferably, will be about two feet up to about 6 feet long.

The particulate absorbent material is loosely packed in the casing so that the resulting article is flexible and capable of being shaped into various configurations around objects in order to contain liquid spills.

The articles of this invention can absorb up to about 100 times their weight of water or aqueous solutions and will not leak (no exudate) up to an applied pressure of about 80 psi.

The articles of this invention can also absorb organic liquids, e.g., gasoline, oil, paint thinners and the like. The absorbent capacity for organic liquids is more limited than that for water. However, up to about 15 times their weight can be absorbed. The compositions of this invention are particularly useful in industrial applications where mixed spills of both aqueous solutions and organic liquids can occur.

In the home, the articles of this invention are used to absorb condensate which forms on windows by placing the article on the window sill. In bathrooms where splashing from the tub or shower is a problem, the articles can be placed outside the tub or shower to contain the water and absorb it. The articles are also useful in basements to absorb moisture which leaks through the walls or floor. The articles can be used in numerous other applications where moisture is a problem.

For industrial applications in addition to the above described uses, the articles can be placed in storage areas around drums of liquids to contain liquid spills or leaks. The articles can also be placed around machinery to dam up and absorb leaks before the liquids run over the floor, thereby reducing hazards for the machine operator.

The following examples describe the invention in more detail. Percentages are by weight unless otherwise indicated.

EXAMPLE 1

A flexible tubing knitted from textured nylon is loosely filled with a mixture of 5 weight percent crosslinked hydrocolloid and 95 weight percent crushed corncobs. The crosslinked hydrocolloid is a graft copolymer of about 91 percent acrylic acid and 9 percent oxidized starch crosslinked with 0.1 percent N,N'-methylene-bis-acrylamide made by the process described in U.S. Pat. No. 4,076,663. After sealing each end of the tubing, it is found to absorb about 20 times it weight of water, about 15 times its weight of saline solution and about 15 times its weight of mineral spirits. In each instance, the liquids are retained when 50 psi pressure is applied to the articles.

EXAMPLE 2

A flexible tubing as described in Example 1 is loosely filled with a mixture of 5 percent of crosslinked hydrocolloid described in Example 1 and 95 percent silica gel. After sealing each end of the tubing, the article is found to absorb 15 times its weight of water and 10 times its weight of mineral spirits. The liquids are retained when up to 50 psi pressure is applied to the articles.

The principles, preferred embodiments and modes of operation of the present invention have been described in the foregoing specification. The invention which is intended to be protected herein, however, is not to be construed as limited to the particular forms disclosed, since these are to be regarded as illustrating rather than restrictive. Variations and changes may be made by those skilled in the art without departing from the spirit of the invention.

What is claimed:

1. An article for use in absorbing fluids which comprises a flexible tubular casing of liquid permeable fabric sealed at each end and containing therein discrete particles of a crosslinked hydrocolloid insoluble in water but capable of absorbing water in admixture with other particulate matter which is insoluble in water but is capable of absorbing water and organic liquids.

2. The article of claim 1 wherein the fabric of the tubular casing is made from nylon fibers.

3. The article of claim 2 wherein the fabric is knitted from textured nylon.

4. The article of claim 1 wherein the hydrocolloid and the other particulate matter are present in the amount of about 5 to about 50 weight percent hydrocolloid and about 95 to about 50 weight percent other particulate matter.

5. The article of claim 1 wherein the hydrocolloid is polymer of water soluble acrylic or vinyl monomers slightly crosslinked with a polyfunctional reactant.

6. The article of claim 5 wherein the hydrocolloid is a graft copolymer of acrylic acid and starch crosslinked with a diunsaturated monomer.

7. The article of claim 1 wherein the other particulate matter is crushed corncobs.

8. The article of claim 1 wherein the other particulate matter is silica gel.

9. The article of claim 1 wherein the other particulate matter is a clay mineral.

10. The article of claim 9 wherein the clay mineral is a mixture of metal oxides.

11. The article of claim 10 wherein the metal oxides are amorphous.

12. The article of claim 1 wherein the other particulate matter is a cellular organic polymer.

13. The article of claim 12 wherein the cellular organic polymer is melt blown polypropylene.

14. A process for controlling liquid spills which comprises placing in contact with the spill an article which is comprised of a flexible tubular casing of liquid permeable fabric sealed at each end and containing therein discrete particles of a crosslinked hydrocolloid insoluble in water but capable of absorbing water in admixture with other particulate matter which is insoluble in water but is capable of absorbing water and organic liquids.

15. The process of claim 14 wherein the article is placed in the path of the liquid spill and absorbs the spill as well as acting as a dam to prevent further spreading of the spill.

16. The process of claim 14 wherein the tubular casing is made from knitted textured nylon.

17. The process of claim 14 wherein the hydrocolloid and the other particulate matter are present in the amount of about 5 to about 50 weight percent hydrocolloid and about 95 to about 50 weight percent other particulate matter.

18. The process of claim 14 wherein the hydrocolloid is a polymer of water soluble acrylic or vinyl monomers slightly crosslinked with a polyfunctional reactant.

19. The process of claim 18 wherein the hydrocolloid is a graft copolymer of acrylic acid and starch crosslinked with a diunsaturated monomer.

20. The process of claim 14 wherein the other particulate matter is crushed corncobs.

21. The process of claim 14 wherein the other particulate matter is silica gel.

22. The process of claim 14 wherein the other particulate matter is a clay mineral.

23. The process of claim 22 wherein the clay mineral is a mixture of metal oxides.

24. The process of claim 23 wherein the metal oxides are amorphous.

25. The process of claim 14 wherein the other particulate matter is a cellular organic polymer.

26. The process of claim 25 wherein the cellular organic polymer is melt blown polypropylene.

* * * * *